US009331400B1

(12) United States Patent
Bianca et al.

(10) Patent No.: US 9,331,400 B1
(45) Date of Patent: May 3, 2016

(54) MALE CONTACT ASSEMBLY

(71) Applicant: Tyco Electronics Corporation, Berwyn, PA (US)

(72) Inventors: Giuseppe Bianca, Temecula, CA (US); Mohamed Ali, Mission Viejo, CA (US); Alex Rengifo, Oceanside, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/577,175

(22) Filed: Dec. 19, 2014

(51) Int. Cl.
*H01R 13/05* (2006.01)
*H01R 4/18* (2006.01)
*H01R 13/17* (2006.01)

(52) U.S. Cl.
CPC . *H01R 4/18* (2013.01); *H01R 13/17* (2013.01)

(58) Field of Classification Search
CPC ..... H01R 13/17
USPC ..... 439/825, 827, 891, 879
See application file for complete search history.

(56) References Cited

U.S. PATENT DOCUMENTS 2,329,880 A * 9/1943 Churchill ..... H01R 13/17 439/870
2,563,713 A * 8/1951 Frei ..... H01R 13/621 439/589
3,697,931 A * 10/1972 Achten ..... H01R 13/052 439/430
4,179,314 A 12/1979 Wikle
4,405,195 A * 9/1983 Cherry ..... H01R 13/193 439/825
4,599,120 A 7/1986 Church et al.
4,780,097 A 10/1988 Piscitelli
5,090,116 A 2/1992 Henschen et al.
5,486,123 A * 1/1996 Miyazaki ..... H01R 13/15 439/825
5,951,337 A * 9/1999 Brake ..... H01R 13/17 439/825
6,001,196 A 12/1999 Harkness et al.
6,129,568 A * 10/2000 Mercurio ..... H01R 11/12 439/166
6,183,885 B1 2/2001 Nakamura et al.
6,250,974 B1 6/2001 Kerek
6,264,508 B1 7/2001 Lehmann
6,475,039 B1 11/2002 Despouys
6,585,833 B1 7/2003 Ordillas
6,994,600 B2 2/2006 Coulon
8,496,504 B2 7/2013 Ono et al.
8,851,940 B2 * 10/2014 Friedhof ..... H01R 13/111 439/843
2004/0229490 A1 11/2004 Bernat et al.
2011/0028039 A1 2/2011 Hangartner et al.

FOREIGN PATENT DOCUMENTS

DE 909594 * 7/1949 ..... H01R 13/17

* cited by examiner

*Primary Examiner* — Tho D Ta

(57) ABSTRACT

A male contact assembly includes a contact body having a mating end and a wire end opposite the mating end. The wire end has a wire barrel configured to receive and be terminated to a wire conductor. The male contact assembly includes a spring body having a front end and a rear end. The rear end is coupled to the mating end of the contact body such that the rear end of the spring body and the mating end of the contact body are coaxially aligned for a mating length. The front end of the spring body includes a male connector comprising at least one compliant beam. The at least one compliant beam of the male connector is resiliently deflected when connected to an external female connector.

18 Claims, 2 Drawing Sheets

MALE CONTACT ASSEMBLY

BACKGROUND OF THE INVENTION

The subject matter described herein relates generally to male contact assemblies.

Connectors are used in many applications, including commercial, consumer and military applications. Connectors are typically used to transmit information (e.g., a voltage, current, etc.) from a first device to a second device. For example, a connector may be used to provide power from a power supply to a circuit. By way of another example, a connector may be used to provide analog and/or digital information from a first circuit to a second circuit.

In order to ensure electrical continuity in a connector, connectors are commonly formed out of a single piece of material. However, there are drawbacks associated with using the same material to manufacture an entire connector. For example, in manufacturing a socket contact, the front (or proximate) end must have high yield strength to avoid permanent deformation when the compliant beams are deflected (e.g., during mating with a corresponding socket), and the rear (or distal) end must be very ductile to allow permanent deformation without cracking (e.g., during crimping around a conductor). Because materials that have a high yield strength are (generally) not very ductile, and visa versa, it is difficult to manufacture an optimal socket contact out of a single piece of material.

A need remains for a multi-piece contact assembly that may be manufactured in a cost effective and reliable manner.

SUMMARY OF THE INVENTION

In one embodiment, a male contact assembly is provided including a contact body having a mating end and a wire end opposite the mating end. The wire end has a wire barrel configured to receive and be terminated to a wire conductor. The male contact assembly includes a spring body having a front end and a rear end. The rear end is coupled to the mating end of the contact body such that the rear end of the spring body and the mating end of the contact body are coaxially aligned for a mating length. The front end of the spring body includes a male connector comprising at least one compliant beam. The at least one compliant beam of the male connector is resiliently deflected when connected to an external female connector.

In another embodiment, a male contact assembly is provided including a contact body having a mating end and a wire end opposite the mating end. The wire end has a wire barrel configured to receive and be terminated to a wire conductor. The contact body is machined to be seamless along the length. The male contact assembly includes a spring body having a front end and a rear end. The spring body is stamped and formed and has a seam extending a length of the spring body between the front end and the rear end. The rear end is coupled to the mating end of the contact body such that the rear end of the spring body and the mating end of the contact body are coaxially aligned for a mating length. The front end of the spring body includes a male connector having at least one compliant beam. The at least one compliant beam of the male connector is resiliently deflected when connected to an external female connector.

In a further embodiment, a male contact assembly is provided including a contact body comprising a mating end and a wire end opposite the mating end. The wire end has a wire barrel configured to receive and be terminated to a wire conductor. The mating end has a boss with an exterior surface.

The male contact assembly includes a spring body having a front end and a rear end. The rear end has a cup with an interior surface. The cup receives the boss such that the interior surface is coupled to the exterior surface of the boss. The front end of the spring body includes a male connector having at least one compliant beam. The at least one compliant beam of the male connector is resiliently deflected when connected to an external female connector.

DETAILED DESCRIPTION OF THE DRAWINGS

Figure 1:
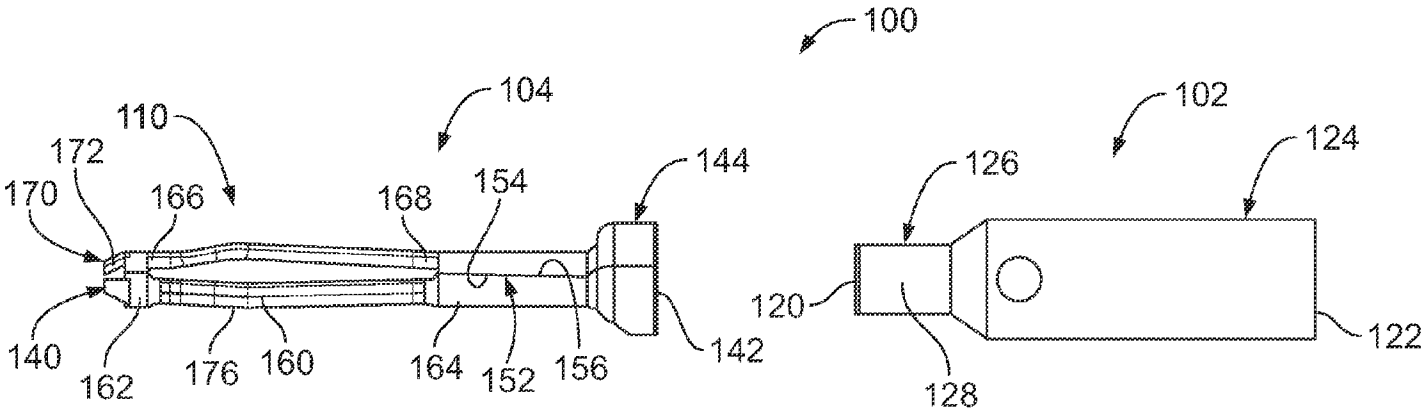
FIG. 1 is an exploded view of a male contact assembly formed in accordance with an exemplary embodiment.
Figure 2:
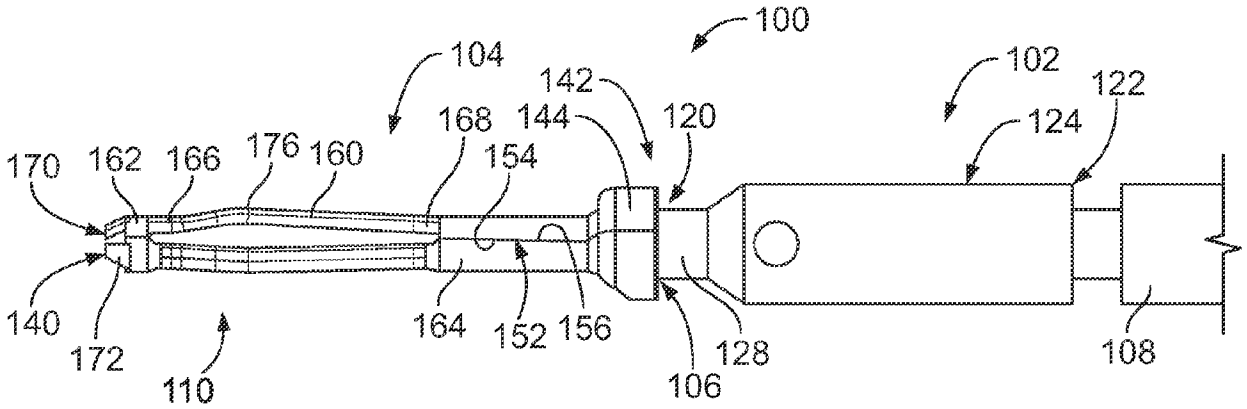
FIG. 2 is an assembled view of the male contact assembly.
Figure 3:
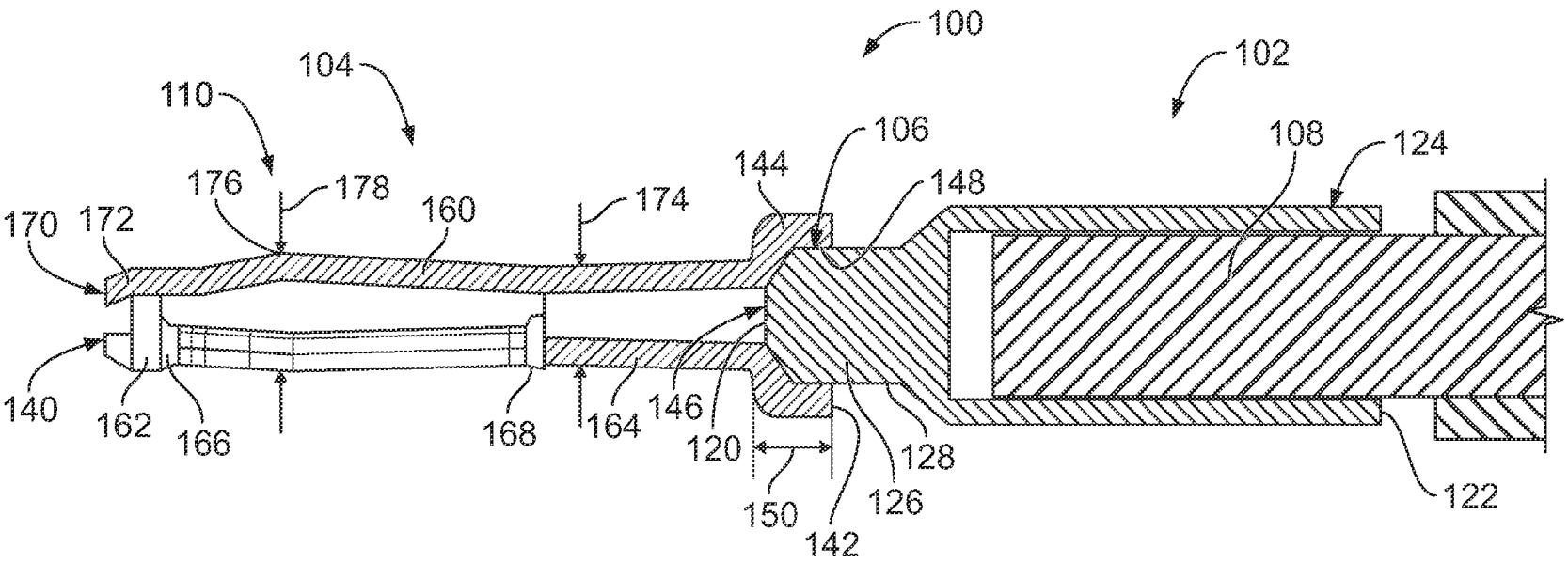
FIG. 3 is a cross sectional view of the male contact assembly in an assembled state.

FIG. 1 is an exploded view of a male contact assembly 100 formed in accordance with an exemplary embodiment. FIG. 2 is an assembled view of the male contact assembly 100. FIG. 3 is a cross sectional view of the male contact assembly 100 in an assembled state.

The male contact assembly 100 includes a contact body 102 and a spring body 104. The spring body 104 is joined to the contact body 102 at an interface 106. The contact body 102 is configured to be electrically connected to a wire conductor 108. The spring body 104 defines a male connector 110 configured to be electrically connected to an external female connector (not shown). The female connector may be a socket that receives the male connector 110.

The contact body 102 extends longitudinally between a mating end 120 and a wire end 122 opposite the mating end 120. The mating end 120 is configured to be mated with the spring body 104. The wire end 122 is configured to be terminated to the wire conductor 108. In an exemplary embodiment, the wire end 122 has a wire barrel 124 that receives the wire conductor 108. Optionally, the wire barrel 124 may define a crimp barrel configured to be crimped to the wire conductor 108. Optionally, the wire barrel 124 may define a solder barrel configured to receive solder to solder the contact body 102 to the wire conductor 108.

The mating end 120 includes a boss 126 that is configured to be mated with the spring body 104. The boss 126 may be cylindrical. Optionally, the boss 126 may be solid and the wire barrel 124 may be hollow. The boss 126 may plug or block the front of the wire barrel 124 to block the wire conductor 108 from loading into the wire barrel 124 and/or to block solder from escaping the wire barrel 124. The boss 126 has an exterior 128. Optionally, the boss 126 may have a smaller diameter than the wire barrel 124. Optionally, the boss 126 may be received in a portion of the spring body 104 such that a portion of the spring body 104 surrounds the exterior 128.

In an exemplary embodiment, the contact body 102 is formed out of a first material, and may be formed out of a single piece of the first material. While the first material can be any conductive material, in various embodiments, the material may be very ductile and allow permanent deformation without cracking. For example, in various embodiments, the first material of the contact body 102 may be brass, leaded nickel copper, gold, and the like. The first material may be ductile to allow crimping of the wire barrel 124 to the wire conductor 108.

The spring body 104 extends longitudinally between a front end 140 and a rear end 142. The rear end 142 is configured to be coupled to the mating end 120 of the contact body 102. The front end 140 defines the male connector 110 that is configured to be electrically connected to the external female connector. The spring body 104 may be hollow.

In an exemplary embodiment, the rear end 142 includes a cup 144 having a cavity 146 that receives a portion of the boss 126. The cup 144 has an interior 148 defining the cavity 146. The interior 148 may engage the exterior 128, such as in a friction fit. Optionally, the contact body 102 may be permanently connected to the spring body 104 at the interface 106, such as by welding, soldering, braising or by other processes. Optionally, a conductive adhesive may be used to connect the contact body 102 to the spring body 104. When the spring body 104 is coupled to the contact body 102, the mating end 120 of the contact body 102 and the rear end 142 of the spring body 104 are coaxially aligned for a mating length 150.

In alternative embodiments, the contact body 102 may be connected to the spring body 104 by a crimp connection. In various embodiments, rather than the contact body 102 being received in the spring body 104, the contact body 102 may be sized and shaped to receive a portion of the spring body 104. For example, the mating end 120 of the contact body 102 may include a cup or other structure defining a cavity that receives the rear end 142 of the spring body 104.

In an exemplary embodiment, the spring body 104 is stamped and formed from a single piece of material. The spring body 104 has good spring properties, including high strength, high elastic limit, and low modulus of elasticity. The spring body 104 is formed out a second material, which may be different from the first material of the contact body 102. While the second material can be any conductive material, in various embodiments, the second material used to form the spring body 104 has a high yield strength to avoid permanent deformation, such as when the compliant beams 160 are deflected. Optionally, the second material used to form the spring body 104 may be a phosphor bronze, beryllium copper, leaded nickel copper, electroplated steel and the like. The material of the spring body 104 may have higher spring characteristics than the material used to form the contact body 102. Optionally, the material used to form the spring body 104 may be further processed, such as by cold working and/or age hardening to improve its yield strength and spring properties.

When stamped and formed, the spring body 104 is generally formed or rolled into a cylindrical shape. The spring body 104 is generally hollow at the interior. The spring body 104 has a seam 152 extending the length between the front end 140 and the rear end 142. The seam 152 is defined by first and second edges 154, 156 that are rolled and extend adjacent each other. Optionally, the first and second edges 154, 156 may abut against each other along at least a portion of the length of the spring body 104. Optionally, the edges 154, 156 may be secured, such as by welding, soldering, braising, adhering or otherwise securing the edges together.

The front end 140 includes at least one compliant beam 160 configured to be resiliently deflected when connected to the external female connector. In an exemplary embodiment, the spring body 104 includes a plurality of compliant beams 160. The compliant beams 160 define a portion of the male connector 110. The compliant beams 160 define a separable interface for electrical connection to the external female connector.

In an exemplary embodiment, the spring body 104 includes a front ring 162 and a rear ring 164 axially offset behind the front ring 162. The rear ring 164 may extend to the cup 144. The front and rear ring 162, 164 extend entirely circumferentially around the spring body 104. The compliant beams 160 extend between the front and rear rings 162, 164. For example, each compliant beam 160 includes a first fixed end 166 extending rearward from the front ring 164 and a second fixed end 168 extending forward from the rear ring 164. The complaint beam 160 extends between the first and second fixed ends 166, 168.

The front ring 162 may be provided at a tip 170 of the spring body 104. Cantilevered fingers 172 may extend forward from the front ring 162. The cantilevered fingers 172 may be angled inward to provide a lead-in guide for mating with the external female connector.

Optionally, the rings 162, 164 may have the same diameter 174. The compliant beams 160 may be bent outward along arcuate paths such that the compliant beams 160 are convex. The complaint beams 160 have mating interfaces 176 configured to mate with the external female connector when plugged therein. The spring body 104 may have a diameter 178 at the mating interfaces 176 that is larger than the diameter 174 of the rings 162, 164.

The compliant beams 160 are biased in a first configuration in the normal or resting state prior to mating with the external female connector. The compliant beams 160 may be forcibly moved into a second configuration when mated with the external female connector. In the second configuration, the compliant beams 160 may be deflected inward such that diameter 178 is reduced. Optionally, the diameter 178 may be reduced to approximately the diameter 174. As the compliant beams 160 are pressed or deflected inward, the compliant beams 160 exert an outward biasing force against the external female connector to maintain an electrical connection therewith.

Having the contact body 102 and the spring body 104 formed separately, the contact body 102 and the spring body 104 may be made from different materials. As such, the contact body 102 may be manufactured in a way and from a material that is advantageous for terminating to the wire conductor 108. For example, the contact body 102 may be machined to be seamless along the length, which may be beneficial for crimping the contact body 102 to the wire conductor 108 as compared to a structure that is stamped and formed and includes a seam. The material selected for the contact body 102 may be a material that is more ductile such that the contact body 102 is more readily crimped to the wire conductor 108. Conversely, the spring body 104 may be manufactured in a way and using a material that is advantageous for terminating to the external female connector. For example, the spring body 104 may be manufactured from a material having good spring characteristics. The spring body 104 may be manufactured using a process that readily allows forming compliant beams 160 used for termination to the external female connector. For example, it may not be practical to machine a spring body 104 to have compliant beams 160. In contrast, stamping and forming the spring body 104 may readily allow forming of the compliant beams 160. As such, the overall male contact assembly 100, including the contact body 102 and spring body 104 may be manufactured in a cost effective and reliable manner for electrically connecting the external female connector with the wire conductor 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A male contact assembly comprising:

a contact body comprising a mating end and a wire end opposite the mating end, the wire end having a wire barrel configured to receive and be terminated to a wire conductor, the contact body being machined to be seamless along a length of the mating end and the wire end;

a spring body comprising a front end and a rear end, the rear end being coupled to the mating end of the contact body such that the rear end of the spring body and the mating end of the contact body are coaxially aligned for a mating length, the front end of the spring body includes a male connector comprising at least one compliant beam, the at least one compliant beam of the male connector being resiliently deflected when connected to an external female connector, the spring body is stamped and formed and includes a seam extending a length of the spring body between the front end and the rear end, the rear end is closed at the seam to receive the mating end of the contact body.

2. The male contact assembly of claim 1, wherein the mating end is coupled to the rear end at a permanent connection.

3. The male contact assembly of claim 1, wherein the mating end is welded to the rear end.

4. The male contact assembly of claim 1, wherein the rear end includes a cup configured to receive the mating end of the contact body, the mating end being secured to the spring body in the cup.

5. The male contact assembly of claim 1, wherein the mating end is solid and blocks the wire barrel.

6. The male contact assembly of claim 1, wherein the contact body is made from a first material and the spring body is made from a second material, the first material is more ductile than the second material, the second material has at least one of a higher elastic limit and a lower modulus of elasticity than the first material.

7. The male contact assembly of claim 1, wherein the spring body is manufactured from one of phosphor bronze, beryllium copper, and leaded nickel copper, and wherein the contact body is manufactured from one of brass and leaded nickel copper.

8. The male contact assembly of claim 1, wherein the wire barrel defines a crimp barrel configured to be crimped to the wire conductor.

9. The male contact assembly of claim 1, wherein the wire barrel defines a solder barrel configured to receive solder to solder the contact body to the wire conductor.

10. The male contact assembly of claim 1, wherein the male connector comprises a plurality of compliant beams.

11. The male contact assembly of claim 1, wherein the male connector includes a first ring and a second ring axially offset from the first ring, the at least one compliant beam includes a fixed end extending from the first ring and a fixed end extending from the second ring, the compliant beam being flexible between the first and second fixed ends.

12. The male contact assembly of claim 1, wherein the male connector includes cantilevered fingers extending from a ring at a tip of the male connector, the cantilevered fingers being angled inward to provide a lead-in guide for mating with the external female connector.

13. The male contact assembly of claim 1, wherein the at least one compliant beam is biased in a first configuration having a first diameter, the at least one compliant beam being forcibly moved into a second configuration having a second diameter when connected to the external female connector, the second diameter being smaller than the first diameter.

14. A male contact assembly comprising:

a contact body comprising a mating end and a wire end opposite the mating end, the wire end having a wire barrel configured to receive and be terminated to a wire conductor, the contact body being machined to be seamless along the length;

a spring body comprising a front end and a rear end, the spring body being stamped and formed and having a seam extending a length of the spring body between the front end and the rear end, the rear end being coupled to the mating end of the contact body such that the rear end of the spring body and the mating end of the contact body are coaxially aligned for a mating length, the front end of the spring body includes a male connector comprising at least one compliant beam, the at least one compliant beam of the male connector being resiliently deflected when connected to an external female connector.

15. The male contact assembly of claim 14, wherein the contact body is made from a first material and the spring body is made from a second material, the first material is more ductile than the second material, the second material has at least one of a higher elastic limit and a lower modulus of elasticity than the first material.

16. The male contact assembly of claim 14, wherein the spring body is manufactured from one of phosphor bronze, beryllium copper, and leaded nickel copper, and wherein the contact body is manufactured from one of brass and leaded nickel copper.

17. A male contact assembly comprising:

a contact body comprising a mating end and a wire end opposite the mating end, the wire end having a wire barrel configured to receive and be terminated to a wire conductor, the mating end having a boss with an exterior surface, the contact body being machined to be seamless along a length of the mating end and the wire end;

a spring body comprising a front end and a rear end, the rear end having a cup with an interior surface, the cup receiving the boss such that the interior surface is coupled to the exterior surface of the boss, the front end of the spring body includes a male connector comprising at least one compliant beam, the at least one compliant beam of the male connector being resiliently deflected when connected to an external female connector, the spring body is stamped and formed and includes a seam extending a length of the spring body between the front end and the rear end.

18. The male contact assembly of claim 17, wherein the contact body is made from a first material and the spring body is made from a second material, the first material is more ductile than the second material, the second material has at least one of a higher elastic limit and a lower modulus of elasticity than the first material.

* * * * *